US011814198B2

(12) United States Patent
Lai

(10) Patent No.: US 11,814,198 B2
(45) Date of Patent: Nov. 14, 2023

(54) RELAXATION DEVICE OF CARDBOARD STRAPPING MACHINE

(71) Applicant: PACKWAY INC., Taichung (TW)

(72) Inventor: Chien-Fa Lai, Taichung (TW)

(73) Assignee: PACKWAY INC., Taichung (TW)

( * ) Notice: Subject to any disclaimer, the term of this patent is extended or adjusted under 35 U.S.C. 154(b) by 345 days.

(21) Appl. No.: 17/319,244

(22) Filed: May 13, 2021

(65) Prior Publication Data

US 2021/0394940 A1 Dec. 23, 2021

(30) Foreign Application Priority Data

Jun. 18, 2020 (CN) ..... 202010560473.2

(51) Int. Cl.
*B65B 13/22* (2006.01)
*B65B 13/18* (2006.01)
*B65B 13/32* (2006.01)

(52) U.S. Cl.
CPC ..... *B65B 13/22* (2013.01); *B65B 13/183* (2013.01); *B65B 13/325* (2013.01)

(58) Field of Classification Search
CPC ..... B65B 13/00; B65B 13/02; B65B 13/04; B65B 13/08; B65B 13/10; B65B 13/14; B65B 13/24; B65B 13/30
See application file for complete search history.

(56) References Cited

U.S. PATENT DOCUMENTS 5,170,612 A * 12/1992 Sumino ..... B65B 13/08 53/589
5,501,252 A * 3/1996 Bartzick ..... B65B 13/30 140/93.2
5,560,187 A * 10/1996 Nagashima ..... B65B 13/04 53/589

FOREIGN PATENT DOCUMENTS

EP 3137381 B1 11/2017

* cited by examiner

*Primary Examiner* — Matthew Katcoff

(57) ABSTRACT

A relaxation device of a cardboard strapping machine includes a connector being movably extended into a top holder. When the connector retreats from a connective channel in the top holder, a middle pressure lever descends to loosen the overlapping straps, so that the overlapping strap is not pulled by the retracted connector to cause misalignment, the adhesion area is complete, and its adhesion strength is good. In contrast, a cardboard pile cannot be fastened by the strap, which is deformed by a drag force when a counter-pressure plate is pulled back, through a traditional strapping machine for bundling cardboards. Furthermore, another forcibly pull-off implementation will weaken the connection strength at an overlapping portion of a strap head and a strap tail of the strap.

6 Claims, 20 Drawing Sheets

RELAXATION DEVICE OF CARDBOARD STRAPPING MACHINE

BACKGROUND OF THE INVENTION

1. Field of the Invention

The present invention relates to a strapping machine used in bundling objects, more particularly, to a cardboard strapping device.

2. Description of the Related Art

In general, corrugated cartons for packing ordinary products inside are manufactured as plain cardboard sheets which should be packed or bundled with strapping bands for handling, selling or usage conveniently. European Patent EP3137381 B1 discloses a method for wrapping bands around objects, and corresponding machines. The method discloses that an object, e.g., a stack of paper or cardboard, moves on a conveyor level. The object has reached the band, tightened between the rear holding device and the band tensioner, and has bulged it out because of its movement in the conveying direction. A band guiding device was brought into the band plane. Since the object has passed the position of the band guide in the horizontal direction, the band guide now lowers. The band guide has now pressed or guided the band behind the object below the conveyor level. The band guiding device has guided the band beneath the conveyor level such that a free space has formed between the band and the conveyor level respectively the object. The counter-pressure plate was introduced into this free space. The front holding device now moves upward to clamp the band tightly between itself and the counter-pressure plate. A band start holding device moves upward and leads thereby the beginning of the band, which is free at this stage, towards the counter-pressure plate. The band is pressed against the counter-pressure plate by the band start holding device and the front holding device at this stage. The loop puller moves in the conveying direction and thus draws the band along with it. A joining device is brought to the band in the area of the counter-pressure plate. The band now overlaps with itself in this area. The connection between the overlapping band sections is just being produced by the joining device. Typical bonding methods are, for example, welding, adhesive bonding and/or melt-fusion. However, a connected band usually adheres to the counter-pressure plate, which will be pulled away from the object such that the connected band is deformed and fails in fastening an object properly, because both the object and the counter-pressure plate are bundled by the band and connected by the joining device.

As disclosed in FIG. 23 for a conventional cardboard strapping machine, a pressure lever holder 80 is pushed up by a cam 81, and a strap head 82 as well as a strap tail 83, both of which overlapped with each other, are hot-melted by a joining device 84 and pressed by a middle pressure lever 85 simultaneously. When the joining device 84 is pulled out between the strap head (the beginning of the strap) 82 and the strap tail 83, a mismatch is observed at the strap head 82 and the strap tail 83. Thus, an overlapping portion 86 at the strap head 82 and the strap tail 83 is reduced by this forcible pull-out operation (FIG. 24) that weakens joint strength at the strap head 82 and the strap tail 83.

BRIEF SUMMARY OF THE INVENTION

Thus, it is an objective of the present invention to overcome the aforementioned shortcoming and deficiency of the prior art by providing a relaxation device of a cardboard strapping machine. When a middle pressure lever of the cardboard strapping machine descends, an overlapping and pressed strap from which a connector of the cardboard strapping machine is retracting will be released, so that the overlapping strap is not pulled by the retracted connector to cause misalignment.

To achieve the foregoing objective, a relaxation device of a cardboard strapping machine of the present invention includes a base, a top holder, a pressure lever holder and a connection device. The base is provided with a conveyor area and a strapping area on which a strapping workbench and a strap guiding arm are installed. A strapping device is provided under the strapping workbench and includes a bottom seat. A supporting holder, a shift fork holder and a spindle are provided on the bottom seat. The spindle is equipped with a first cam, a second cam and a third cam. The first cam has a recessed portion therein. The third cam is provided with a front convex portion and a rear convex portion. The top holder is pivotally mounted to the supporting holder of the bottom seat and has a top portion and a connective channel extending through an upper end of the top holder and to the top portion. The top holder can be driven by the second cam. The pressure lever holder is installed in the top holder and movable inside the top holder up and down. The pressure lever holder is provided with three pressure lever holes, an abutting roller and a groove. The three pressure lever holes respectively accommodate a front pressure lever, a middle pressure lever and a rear pressure lever. The front pressure lever, the middle pressure lever and the rear pressure lever are respectively provided with a first concave portion and a first lever top, a second concave portion and a second lever top, and a third concave portion and a third lever top. A spring is received in each of the three pressure rod hole. The groove accommodates a stop lever which is received in the first, second and third concave portions, so that the front pressure lever, the middle pressure lever and the rear pressure lever ascend or descend synchronously with the stop lever following the pressure lever holder to ascend or descend. The connection device includes a connector and a shift fork. The connector is movably inserted into the top holder. The shift fork is pivotally mounted to the shift fork holder through a shift fork shaft and provided with a fork wheel at an end thereof. The fork wheel abuts against the first cam so that the connector can be extended into or retracted from the top holder during rotation of the first cam. The abutting roller abuts against the third cam. A length of strap is pulled into the strapping device by the strap guiding arm, overlapped under the top portion and pressed by the front pressure lever, the middle pressure lever and the rear pressure lever. The relaxation device is characterized in that the third cam is further provided with a recess. When the abutting wheel is in the recess of the third cam, the fork wheel just moves away from the recessed portion of the first cam, the strap overlapped under the top portion is still pressed by the front pressure lever and the rear pressure lever, but the middle pressure lever descends to loosen the overlapping straps at the middle pressure lever, so that when the connector retreats from the connective channel, the strap is not pulled by the retracted connector to cause misalignment.

In a preferred form, when the abutting roller is pushed up by the front convex portion of the third cam, a vertical distance between a bottom of the stop lever and a bottom of each of the first and third concave portions is greater than a radial concave depth of the recess relative to the front convex portion of the third cam.

Preferably, the recess is provided between the front convex portion and the rear convex portion of the third cam. When the abutting roller arrives at the rear convex portion, the strap overlapped is again pressed by the middle pressure lever.

Preferably, the connector is a welding head, an ultrasonic welding head or a heating plate.

The present invention will become clearer in light of the following detailed description of an illustrative embodiment of this invention described in connection with the drawings.

DESCRIPTION OF THE DRAWINGS

The illustrative embodiment may best be described by reference to the accompanying drawings where.

DETAILED DESCRIPTION OF THE INVENTION

Figure 1:
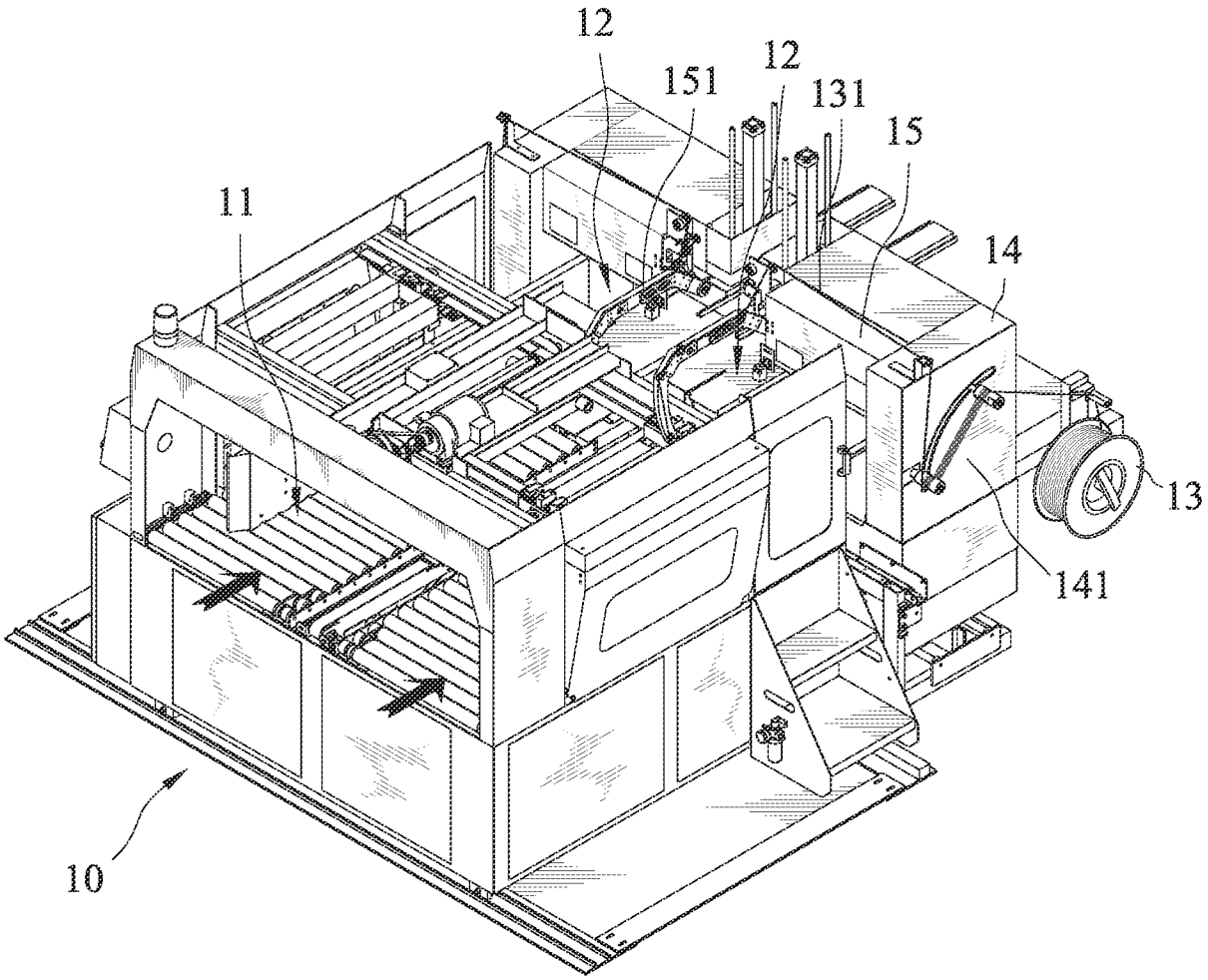
FIG. 1 shows a diagrammatic, perspective view of a cardboard strapping machine of the present invention.

FIG. 1 shows a cardboard strapping machine of the present invention which includes a base 10, a conveyor area 11 provided on the base 10 for conveying objects such as cardboards, and two strapping areas 12 at the tail end of the conveyor area 11. The outer side of each strapping area 12 is provided with a strap reel 13, an upright housing 14 and a horizontal housing 15. The strap reel 13 accommodates a bundle of strap (strapping band) 131 which passes through a strap storage device 141 on the outer side of the upright housing 14 and bypasses the horizontal housing 15 to a strap guiding arm 151.

Figure 2:
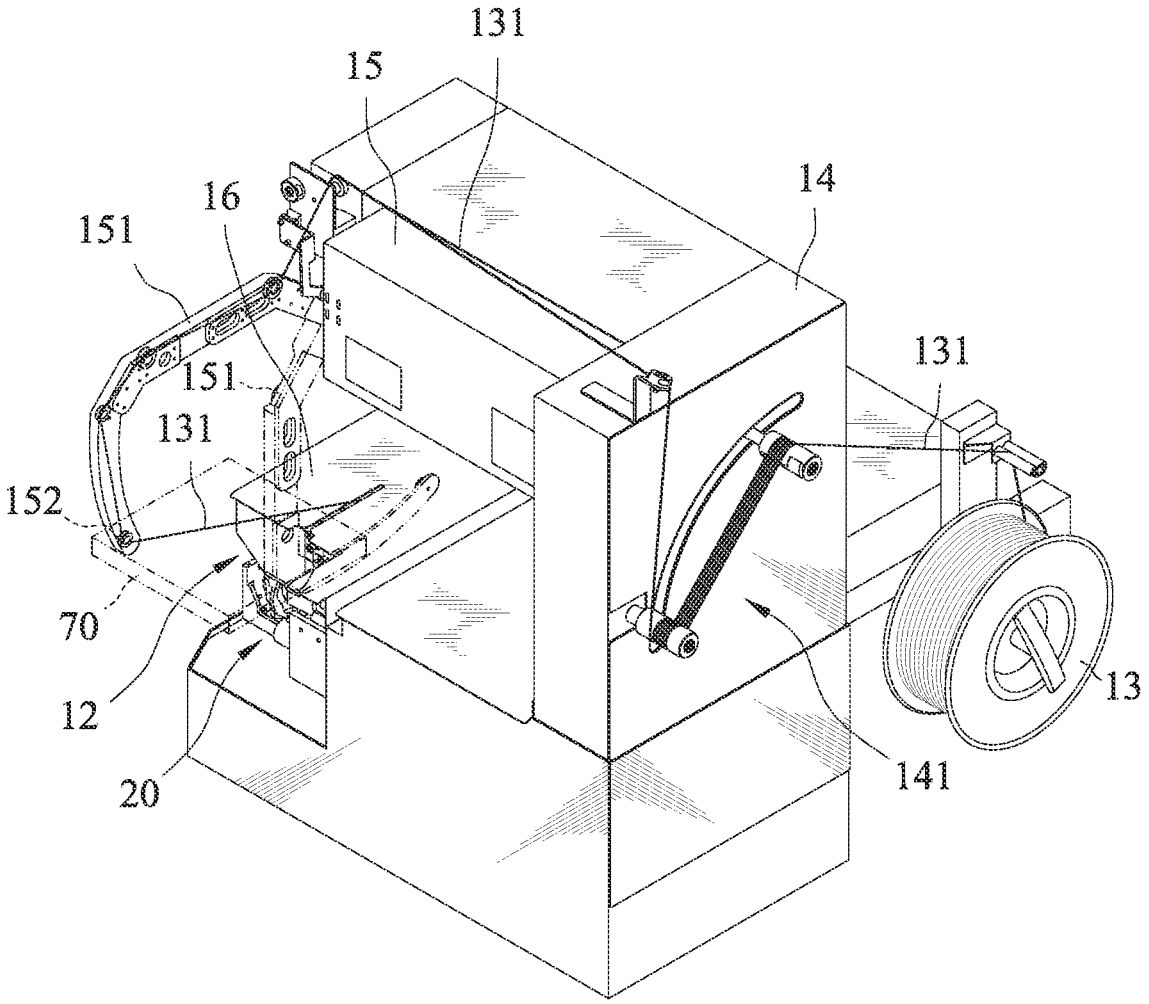
FIG. 2 shows a schematic view for a strapping area of the cardboard strapping machine of FIG. 1.

Referring to FIG. 2, the strapping area 12 is provided with a strapping workbench 16 and a strapping device 20 under the strapping workbench 16. The strap guiding arm 151 is equipped with several strap guiding pulleys 152 located at one side thereof and used to limit movements of a length of strap 131 along the strap guiding arm 151. The strap 131 under controls both of the strap guiding pulleys 152 of the strap guiding arm 151 and the strapping device 20 can wrap around an object 70 (such as a cardboard pile).

Figure 3:
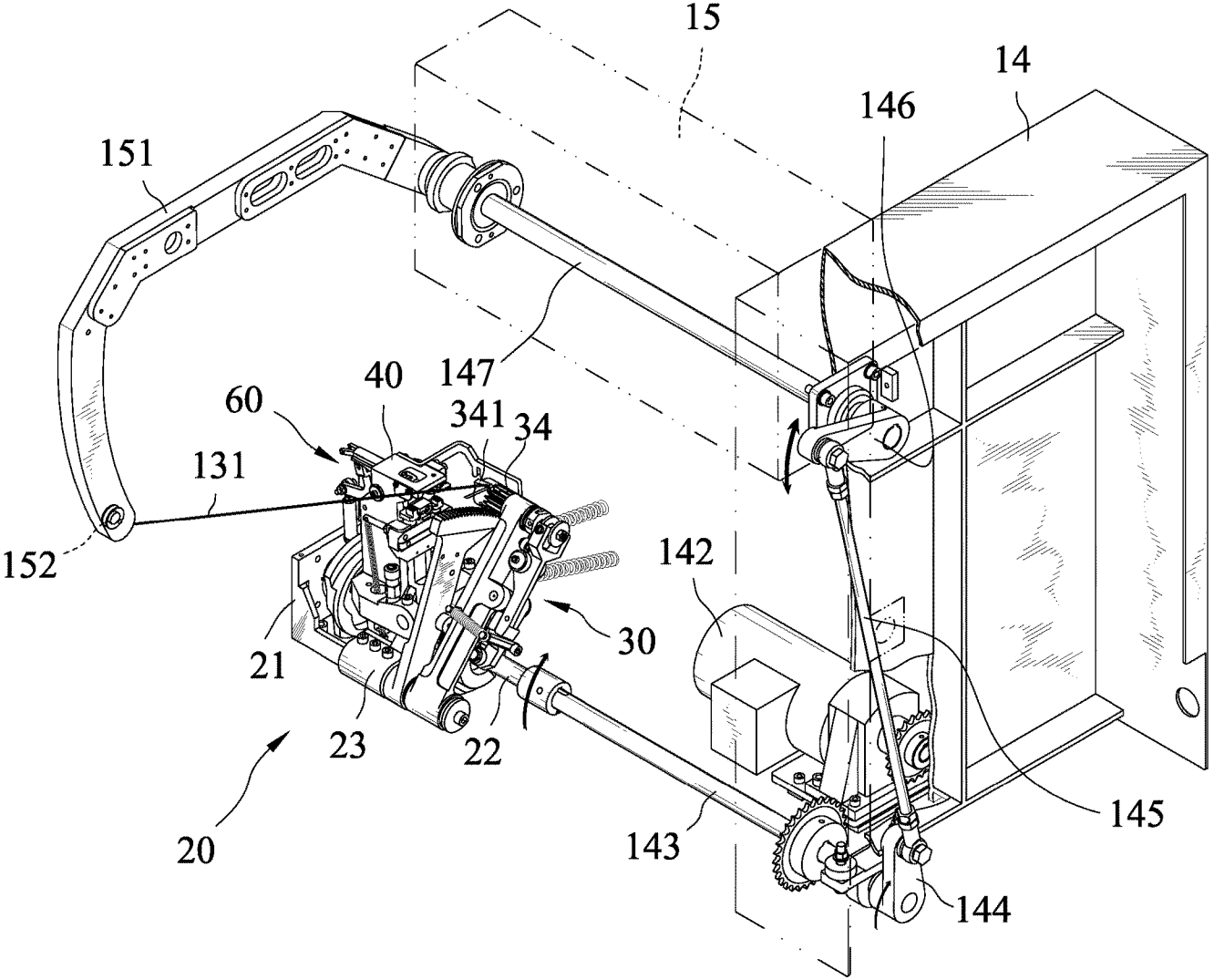
FIG. 3 is a schematic view for a linkage structure based on a strap guiding arm and a strapping device of the cardboard strapping machine.
Figure 4:
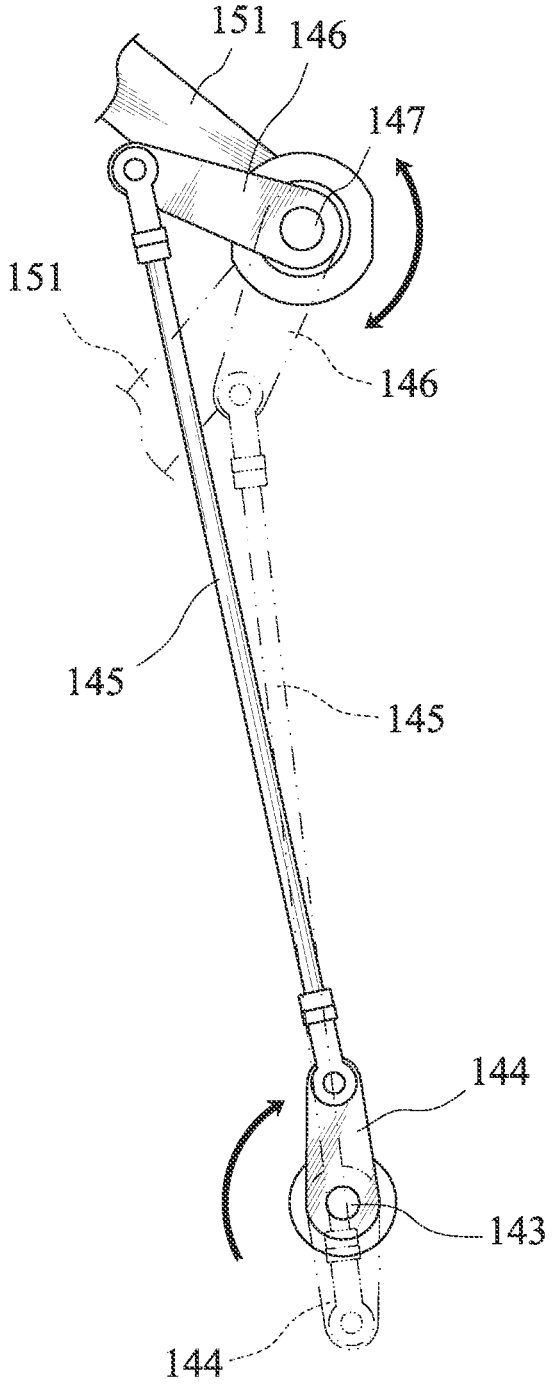
FIG. 4 is a schematic view for a linkage structure based on a lower swing arm and an upper swing arm of the cardboard strapping machine.

FIGS. 3 and 4 illustrate a linkage structure of the strap guiding arm 151 and the strapping device 20. The upright housing 14 accommodates a motor 142 therein. The motor 142 links and drives a transmission shaft 143 to rotate clockwise. The transmission shaft 143 has a first end connected with a lower swing arm 144, which links an upper swing arm 146 through a link rod 145. When the lower swing arm 144 makes one revolution, the upper swing arm 146 completes a reciprocating swing motion between a top dead center and a bottom dead center. The upper swing arm 146 is connected to the strap guiding arm 151 through a connecting shaft 147, so that the strap guiding arm 151 will follow the upper swing arm 146 for a swing motion up and down. The transmission shaft 143 has a second end connected with a spindle 22 of the strapping device 20. Accordingly, the transmission shaft 143 in a rotary motion drives the strap guiding arm 151 and the strapping device 20 to rotate synchronously. The strapping device 20 includes a bottom seat 21, the spindle and a grappling axle holder 23. The spindle 22 and the grappling axle holder 23 are installed on the bottom seat 21. A grappling device 30 is mounted on the grappling axle holder 23 and equipped with a gripper 341. The strap 131 held by the strap guiding pulleys 152 of the strap guiding arm 151 and the gripper 341 is tensioned and ready to bundle an object 70.

Figure 5:
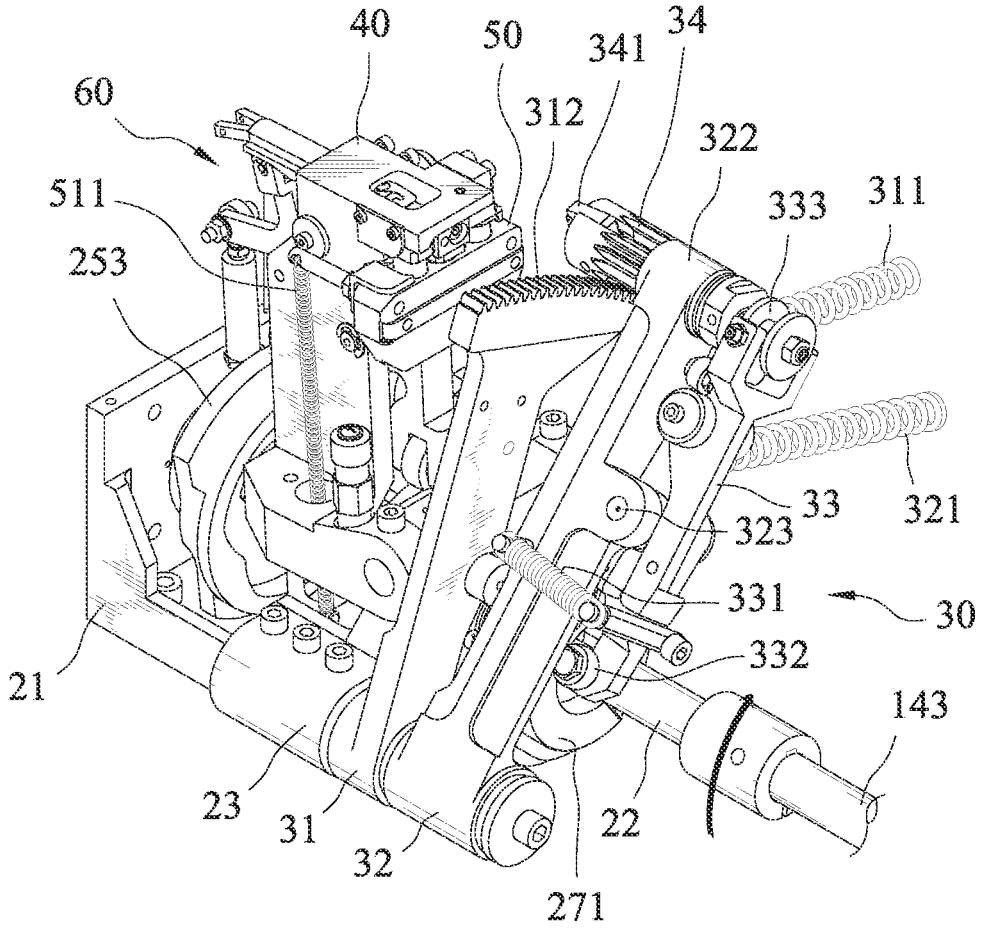
FIG. 5 shows a perspective view of the strapping device of FIG. 3.
Figure 6:
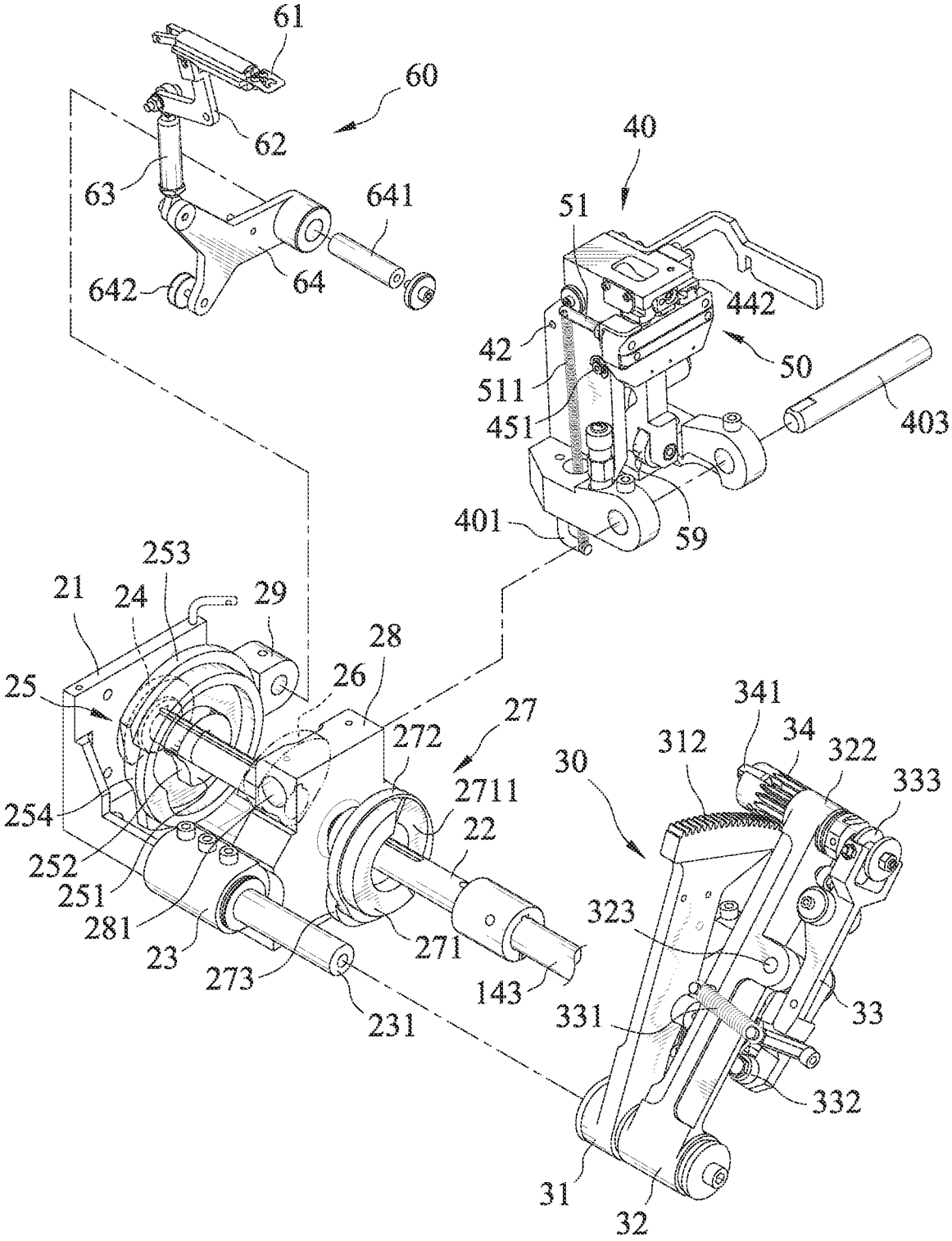
FIG. 6 is an exploded view of the strapping device of FIG. 5.

Referring to FIGS. 5 and 6, the spindle 22 is equipped with four cams, that is, a first cam 24, a second cam 25, a third cam 26 and a fourth cam 27, all of which rotate synchronously. The four cams 24, 25, 26 and 27 drive a connection device 60, a top holder 40, a pressure lever holder 50 and the grappling device 30, respectively. The second cam 25 includes an inner cam 251 and an outer cam 253. The inner cam 251 has an internal recess 252, and the outer cam 253 has an external recess 254 corresponding to the internal recess 252. The fourth cam 27 includes a front cam 271, a middle cam 272, and a rear cam 273. The front cam 271 on which a concave portion 2711 is designed drives corresponding components to move in an axial direction of the spindle 22. The middle cam 272 and the rear cam 273, each of which has a concave-convex outer periphery, drive corresponding components to move in a radial direction of the spindle 22.

The grappling device 30 is mounted on the grappling axle holder 23 through a shaft 231 and includes an arc gear wheel 31 and a holding rod 32. Both the arc gear wheel 31 and the holding rod 32 are pivotally mounted to the shaft 231. The arc gear wheel 31 and the holding rod 32 abut against the fourth cam 27, respectively based on resilience of springs 311 and 321, and are actuated correspondingly. That is, the arc gear wheel 31 connecting the spring 311 follows the rear cam 273 to swing in the radial direction, and the holding rod 32 connecting the spring 321 follows the middle cam 272 to swing in the radial direction. One end of the arc gear wheel 31 is provided with arc-shaped gear teeth 312, and the holding rod 32 is equipped with a gripper holder 322 which corresponds to the arc-shaped gear teeth 312. A rotatable toothed holding roller 34 is pivotally mounted on the gripper holder 322 and equipped with a retractable and openable gripper 341. The holding rod 32 has a pivot 323 to which a swingable grappling rod 33 is pivotally mounted. A spring 331 is connected between the grappling rod 33 and the holding rod 32, so that the grappling rod 33 and the holding rod 32 can move together. The grappling rod 33 equipped with an abutting roller 332 at one end thereof with which the front earn 271 is abutted follows the front cam 271 to swing in the axial direction. The other end of the grappling rod 33 is equipped with a push-pull rod 333 which is connected to the gripper 341 to drive to the gripper 341 to extend or retract on the toothed holding roller 34.

During actuation of the grappling device 30, when the fourth cam 27 is being driven by the rotating spindle 22, the arc gear wheel 31 follows the rear cam 273 to swing in the radial direction, so that the arc-shaped gear teeth 312 enables a rotational movement relative to the toothed holding roller 34, and the toothed holding roller 34 follows the middle cam 272 to swing in the radial direction. The swing amplitude of the holding rod 32 is smaller than that of the arc gear wheel 31. Meanwhile, the grappling rod 33 follows the front cam 271 to swing in the axial direction, so that the gripper 341 actuated by the push-pull rod 333 is opened and retracted into the toothed holding roller 34. In this stage, the spindle 22 which is turned 180 degrees completes only half a stroke. Then, the spindle 22 continues to rotate clockwise, and the push-pull rod 333 drives the gripper 341 to extend from the toothed holding roller 34 and be closed tightly.

The bottom seat 21 is further equipped with a supporting holder 28 and a shift fork holder 29. The top holder 40 is pivotally mounted to the supporting holder 28 with a pivot 403 engaged in a supporting hole 281 in the supporting holder 28, so that the top holder 40 swings based on the supporting hole 281 as a center. The pressure lever holder 50 is installed in the top holder 40 and equipped with an extension rod 51. A spring 511 is provided between the extension rod 51 and a spring rod 401 provided at the top holder 40, so that the pressure lever holder 50 can move inside the top holder 40 up and down.

The connection device 60 includes a connector 61, a strut 62, a telescopic joint lever 63 and a Y-shaped shift fork 64, all of which are connected with one another. The connector 61 is movably inserted into the top holder 40. The strut 62 is pivotally mounted to a pivot hole 42 in the top holder 40. The shift fork 64 has one end connected with the telescopic joint lever 63 and is provided with a fork wheel 642 at the other end thereof. The shift fork 64 is pivotally mounted to the shift fork holder 29 through a shift fork shaft 641. Based on the action of the first cam 24 and the fork wheel 642, the connector 61 of the connection device 60 can be extended into or retracted from the top holder 40.

Figure 8:
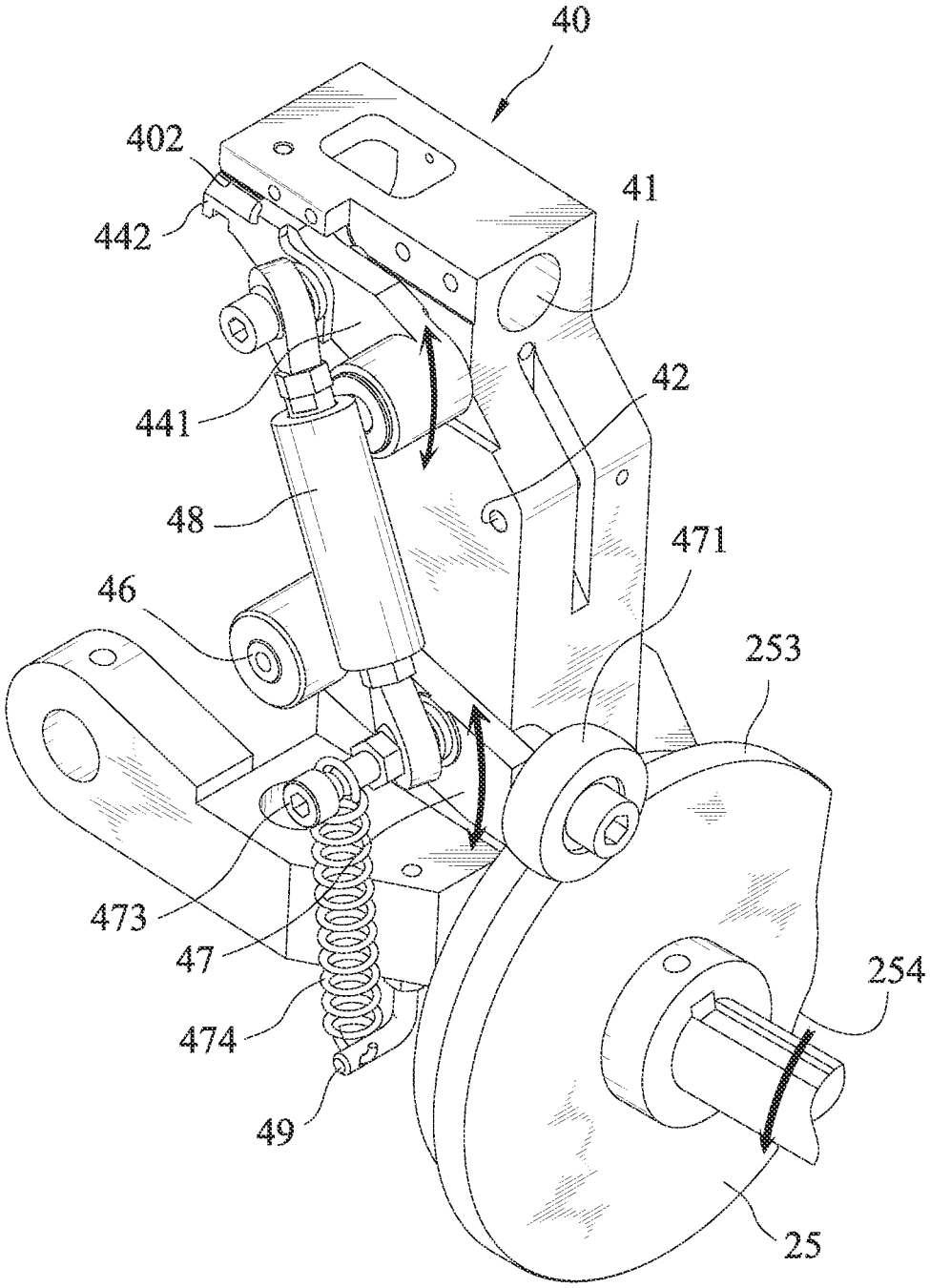
FIG. 8 illustrates the top holder and the pressing lever, both of which are assembled together.
Figure 9:
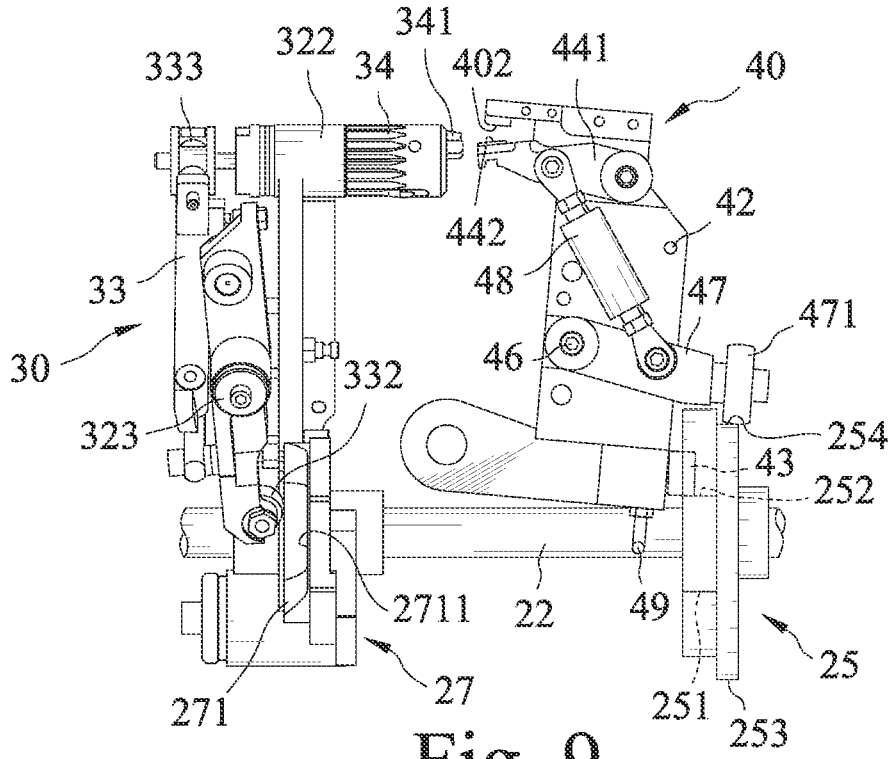
FIG. 9 is a schematic view which illustrates a relative position for the top holder, the pressing lever and a grappling device before an object is bundled.
Figure 10:
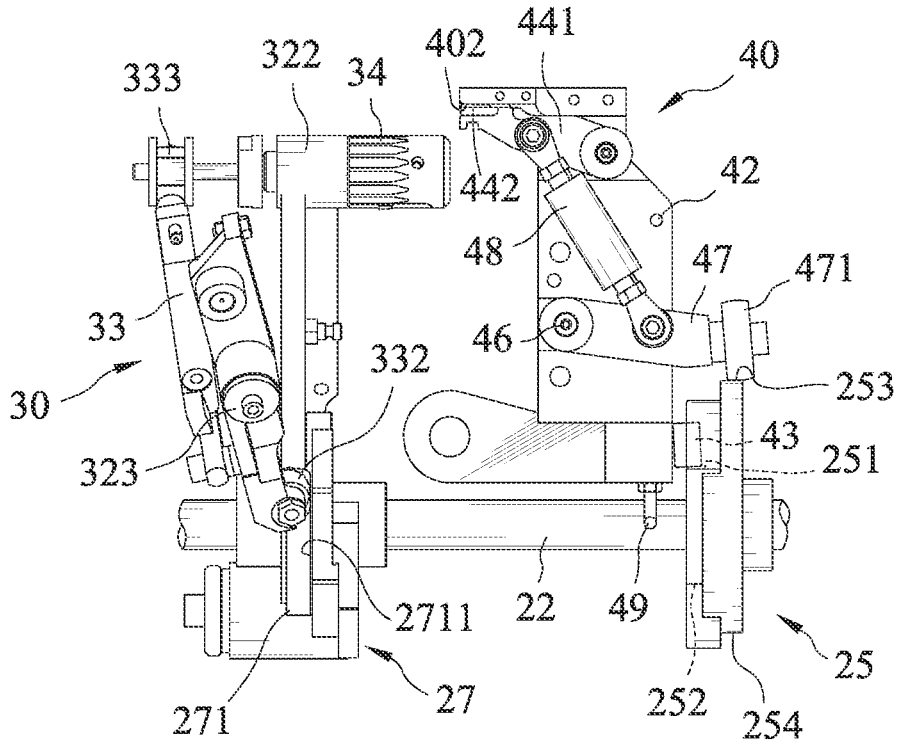
FIG. 10 is a schematic view which illustrates a relative position for the grappling device of FIG. 9 when it gets close to the top holder and the pressing lever.

FIG. 7 to FIG. 10 illustrate the top holder 40 viewed from another angle dissimilar to FIG. 5. The top holder 40 has a top portion 402 and a connective channel 41 extending through an upper end of the top holder 40 and to the top portion 402. The connector 61 can extend into or retract from the connective channel 41. The top holder 40 is provided with a top holder roller 43 at a lower end thereof. A pressing lever shaft 44, a pivot hole 45 and a linkage shaft 46 are provided at one side of the top holder 40. A pressing lever 441 is pivotally mounted to the pressing lever shaft 44. A link rod 47 is pivotally mounted to the linkage shaft 46, and both ends of the link rod 47 are respectively provided with an abutting roller 471 and a pivot hole 472. The link rod 47 and the pressing lever 441 are connected by a joint lever 48. The link rod 47 is centrally provided with an extension rod 473 which is connected with a spring rod 49 at a bottom of the top holder 40 via a spring 474. The top holder roller 43 and the abutting roller 471, under the action of the spring 474, abut against the inner cam 251 and the outer cam 253 of the second cam 25, respectively. The top holder roller 43 can be pushed by the inner cam 251 such that the top holder 40 moving upward gets close to the gripper 341, as shown in FIG. 10. Meanwhile, the outer cam 253 can push up the abutting roller 471, so that a pressing portion 442 of the pressing lever 441 abuts against the top portion 402. The internal recess 252 and the external recess 254 on the second cam 25 correspond to each other. When the internal recess 252 and the external recess 254 are rotated to an upward position, the top holder roller 43 and the abutting roller 471 are respectively fall in the internal recess 252 and the external recess 254, the top holder 40 is slant and away from the gripper 341, and the pressing portion 442 is disengaged from the top portion 402, as show in FIG. 9. The pivot hole 45 is penetrated by a chute axle 451 such that the pressure lever holder 50 is restricted inside the top holder 40 for up and down movements.

When the fourth care 27 rotates clockwise, the front cam 271 pushes the abutting roller 332 away, so that the grappling rod 33 rotates about the pivot 323, and the gripper 341 is pushed out of the toothed holding roller 34 by the push-pull rod 333, as shown in FIG. 9. When the abutting roller 332 falls in the concave portion 2711 of the front cam 271, the gripper 341 is dragged into the toothed holding roller 34 by the push-pull rod 333, as shown in FIG. 10.

Referring to FIGS. 3, 4, 9~13, when the lower swing arm 144 is turned 180 degrees clockwise, the upper swing arm 146 swinging from the top dead center to the bottom dead center actuates the strap guiding arm 151 to enable a strapping step (from the status to be bundled to the bundling completion status), and finally return to the status to be bundled for bundling. The actuation of the strap guiding arm 151 is divided into three stages: (1) first stage, an object is ready to be bundled; (2) second stage, the object is being bundled by a length of the strap; (3) third stage, the object has been bundled. In the first stage (FIG. 11), a length of strap 131 among; the strap guiding pulleys 152 and the gripper 341 is tensioned. When an object 70 is pushed into the strapping workbench 16 from the conveyor area 11, the transmission shaft 143 is triggered to rotate. The top holder 40 is pushed up and gets close to the gripper 341 (FIG. 10).

The gripper 341 driven by the push-pull rod 333 is opened and retracted into the toothed holding roller 34, so that the strap head 132 of the strap 131 is transferred from gripper 341 to and pressed between the pressing portion 442 and top portion 402. Then, the strap guiding arm 151 rotates counterclockwise. In the second stage (FIG. 12), the strap guiding arm 151 enters under the strapping workbench 16, and at the same time, the input object 70 shifted to a proper position is bundled by the strap 131 which is pushed by the object 70. At this time, both the arc gear wheel 31 and the holding rod 32 swing and deviate from the top holder 40 because of the rotating fourth cam 27, and the toothed holding roller 34 driven by the arc-shaped gear teeth 312 is actuated and turned 360 degrees. In the third stage (FIG. 13), the strap guiding arm 151 moves under the strapping workbench 16 and makes the strap 131 overlap with itself between the top holder 40 and the pressure lever holder 50. At this moment, the push-pull rod 333 pushes the gripper 341 out of the toothed holding roller 34, and the gripper 341 clamps the strap 131 between the pressure lever holder 50 and the strap guiding pulley 152 at the same time. Then, the strap 131 is cut through the action of the pressure lever holder 50, and the cut strap 131 remains in the pressure lever holder 50 as a strap tail 133. The strap head 132 and the strap tail 133 will complete the bundling of the object 70 through the actions of the top holder 40, the pressure lever holder 50 and the connection device 60. A new strap head 132 is created from the portion of the strap 131 which has been cut and restrained within the pressure lever holder 50, the gripper 341 and the strap guiding pulleys 152. Then, the first stage is resumed after the strap guiding arm 151, the arc gear wheel 31, the holding rod 32 and the arc-shaped gear teeth 312 swing back. Both the arc gear wheel 31 and the holding rod 32 get close to the top holder 40. The arc-shaped gear teeth 312 drive the toothed holding roller 34 to return to the status to be bundled for a next cycle. Moreover, a new length of strap 131 is ready to bundle another object 70 when the gripper 341 and the new strap head 132 following the toothed holding roller 34 and the strap guiding arm 151 return to the home position.

Figure 7:
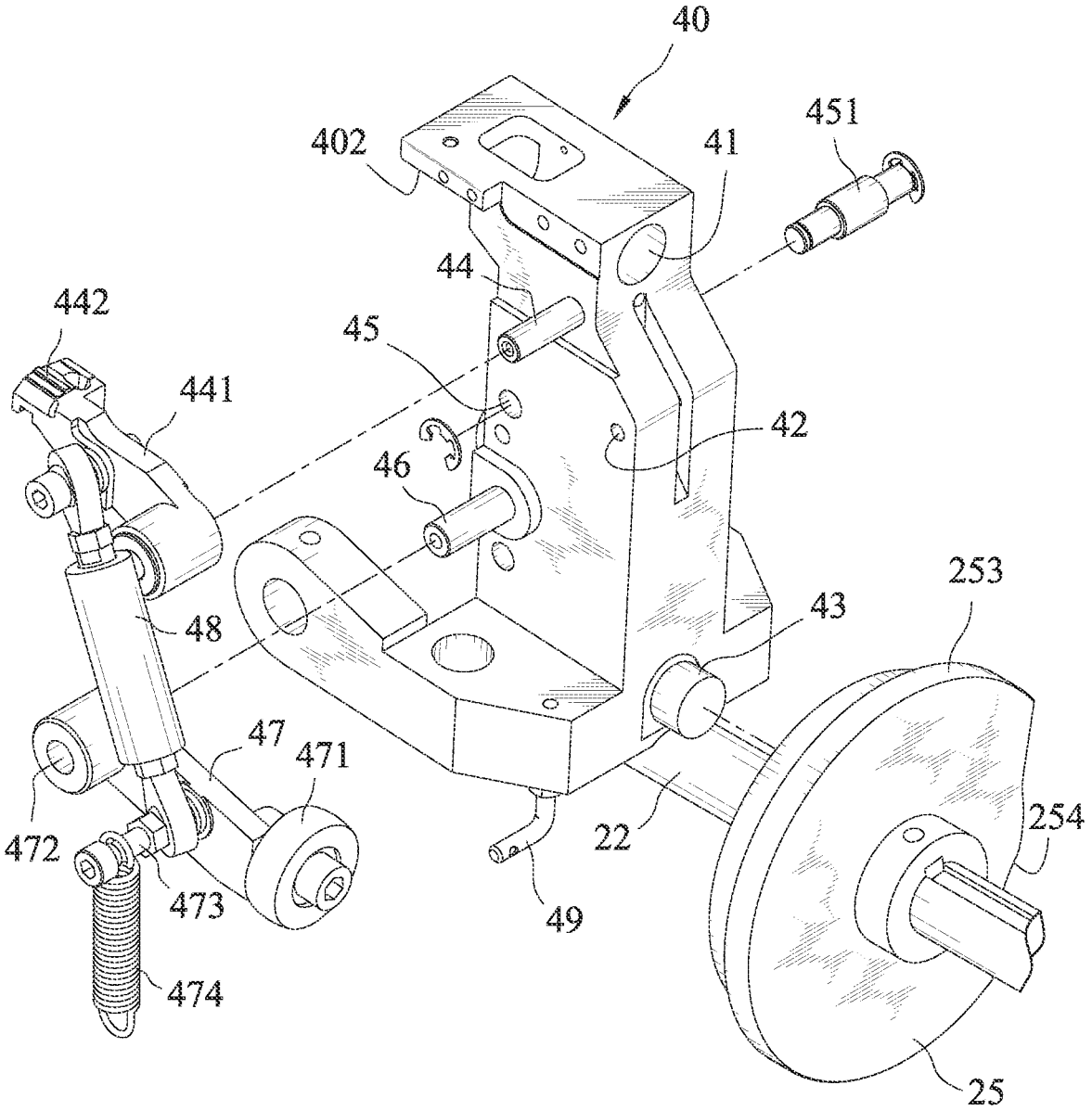
FIG. 7 is an exploded view for a top holder and a pressing lever of the cardboard strapping machine.

Referring to FIG. 14 to FIG. 17, the first cam 24 is provided with a recessed portion 241, and the rotation of the first cam 24 causes the shift fork 64 to swing. When the fork wheel 642 abuts the first cam 24 (FIG. 14), the shift fork 64 swings downward and the connector 61 retracts away from the top portion 402 of the top holder 40 and is in a state of waiting for connection. In the case of the fork wheel 642 is in the recessed portion 241 (FIG. 16), the shift fork 64 swings upward and lifts the strut 62 such that the connector 61 extends to the top portion 402. The viewing angle of FIGS. 15 and 17 similar to FIGS. 7 and 8 is from the rear side of the bottom seat 21.

Figure 18:
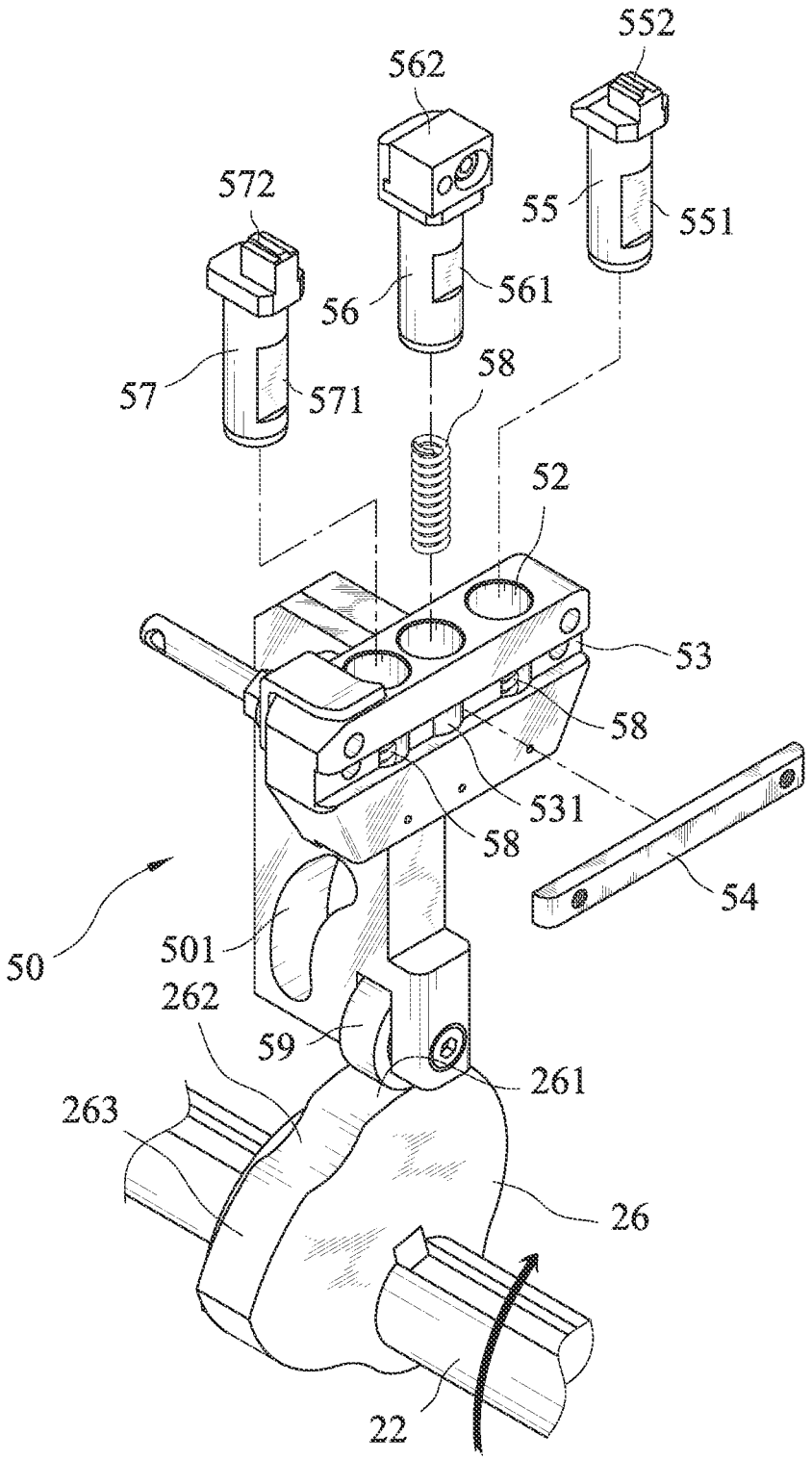
FIG. 18 is an exploded view of a pressure lever holder.
Figure 19:
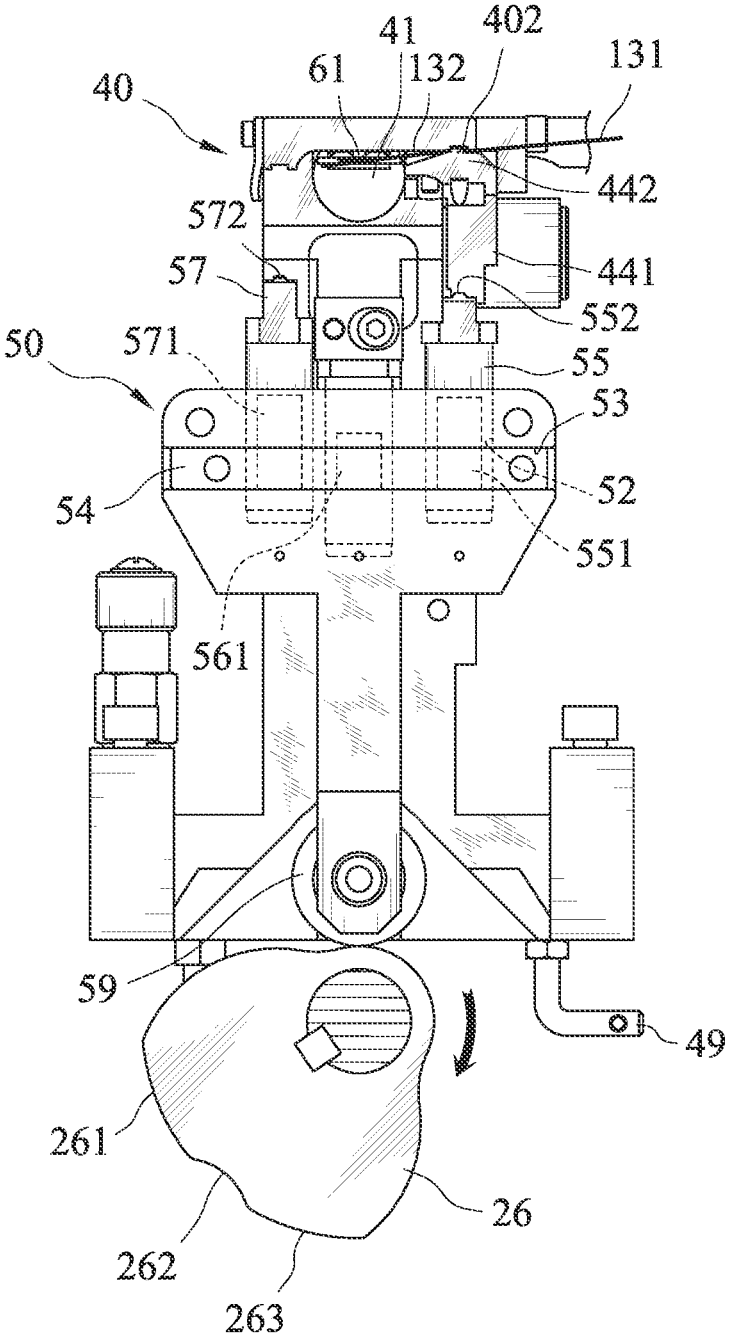
FIG. 19 is a schematic view of a relative position for the top holder and the pressure lever holder at a bottom dead center of a third cam.

Referring to FIG. 18, the pressure lever holder 50 is provided with a sliding groove 501, and both the sliding groove 501 and the pivot hole 45 are penetrated by the chute axle 451 (see FIG. 7), so that the pressure lever holder 50 is restricted from moving in the sliding groove 501. The pressure lever holder 50 is further provided with three pressure lever holes 52 and a groove 53 located in the front side thereof and intersecting with each pressure lever hole 52. Pressure lever slots 531 are respectively formed at the intersections of the groove 53 and the pressure lever holes 52. The groove 53 accommodates a stop lever 54 which extends into pressure lever holes 52. The pressure lever holes 52 respectively accommodate a front pressure lever 55, a middle pressure lever 56 and a rear pressure lever 57. The front pressure lever 55, the middle pressure lever 56 and the rear pressure lever 57 are respectively provided with a first concave portion 551 and a first lever top 552, a second concave portion 561 and a second lever top 562, and a third concave portion 571 and a third lever top 572. In this embodiment, the lengths of the first concave portion 551 and the third concave portion 571 in a vertical direction are respectively greater than the length of the second concave portion 561 in the vertical direction. A spring 58 is first placed in each pressure rod hole 52, and then the front pressure rod 55, the middle pressure rod 56 and the rear pressure rod 57 are respectively placed in the pressure lever holes 52, with the first concave portion 551, the second concave portion 561 and the third concave portion 571 being lower than the pressure lever slot 531 for installation of the stop lever 54 in the first, second and third concave portions 551, 561, 571. Accordingly, the front pressure lever 55, the middle pressure lever 56 and the rear pressure lever 57 can be driven by the stop lever 54. When the stop lever 54 follows the pressure lever holder 50 to move up or down in the vertical direction, the front pressure lever 55, the middle pressure lever 56 and the rear pressure lever 57 ascend or descend synchronously. The lower end of the pressure lever holder 50 is provided with an abutting roller 59 which abuts against the third cam 26, so that the pressure lever holder 50 can be driven by the third cam 26 for an ascending or descending motion. The third cam 26 is provided with a front convex portion 261, a recess 262, and a rear convex portion 263.

Figure 20:
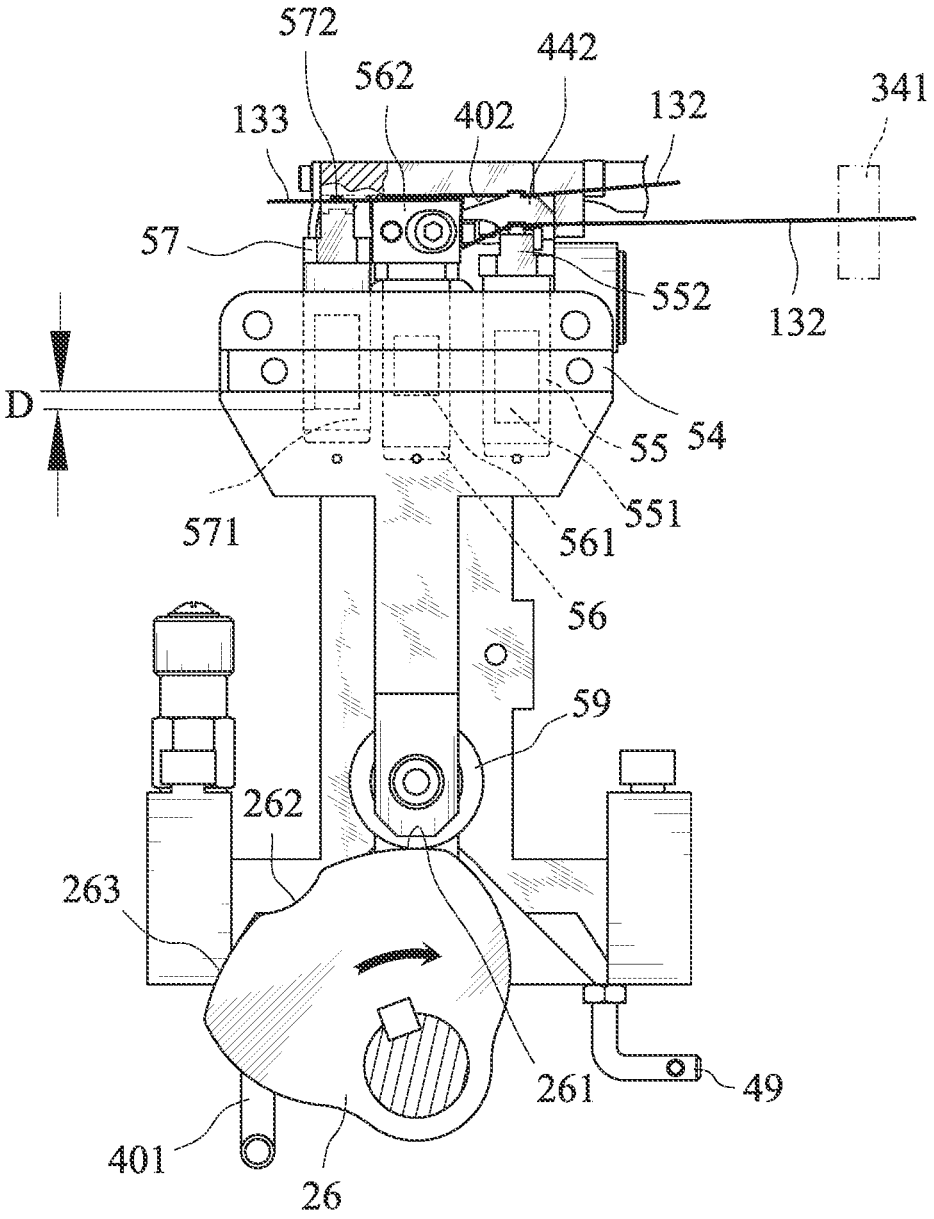
FIG. 20 is a schematic view which illustrates a stroke for the pressure lever holder abutted by a front convex portion of the third cam with a length of strap preparing to be cut and connected.
Figure 21:
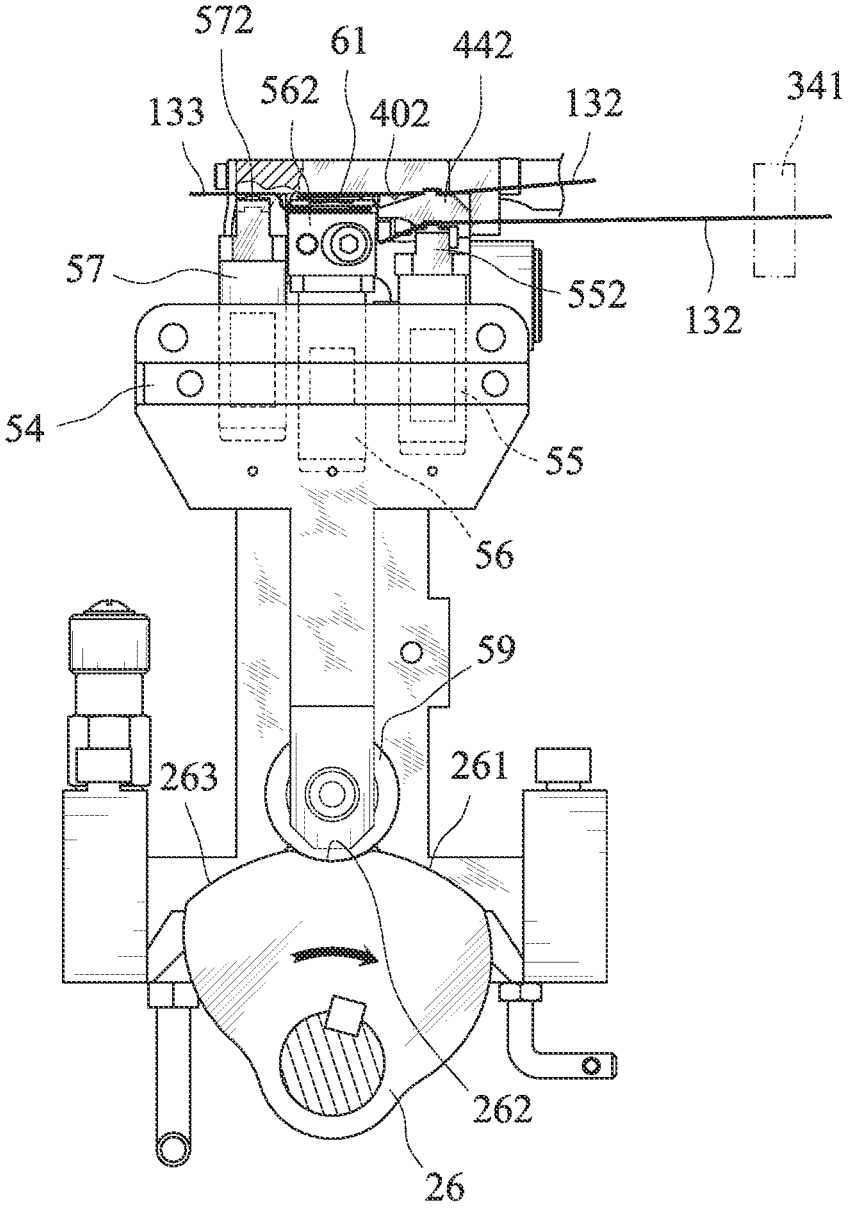
FIG. 21 is a schematic view which illustrates a stroke for the pressure lever holder falling in a recess of the third cam to allow the strap tail overlapping with the strap head to relax.
Figure 22:
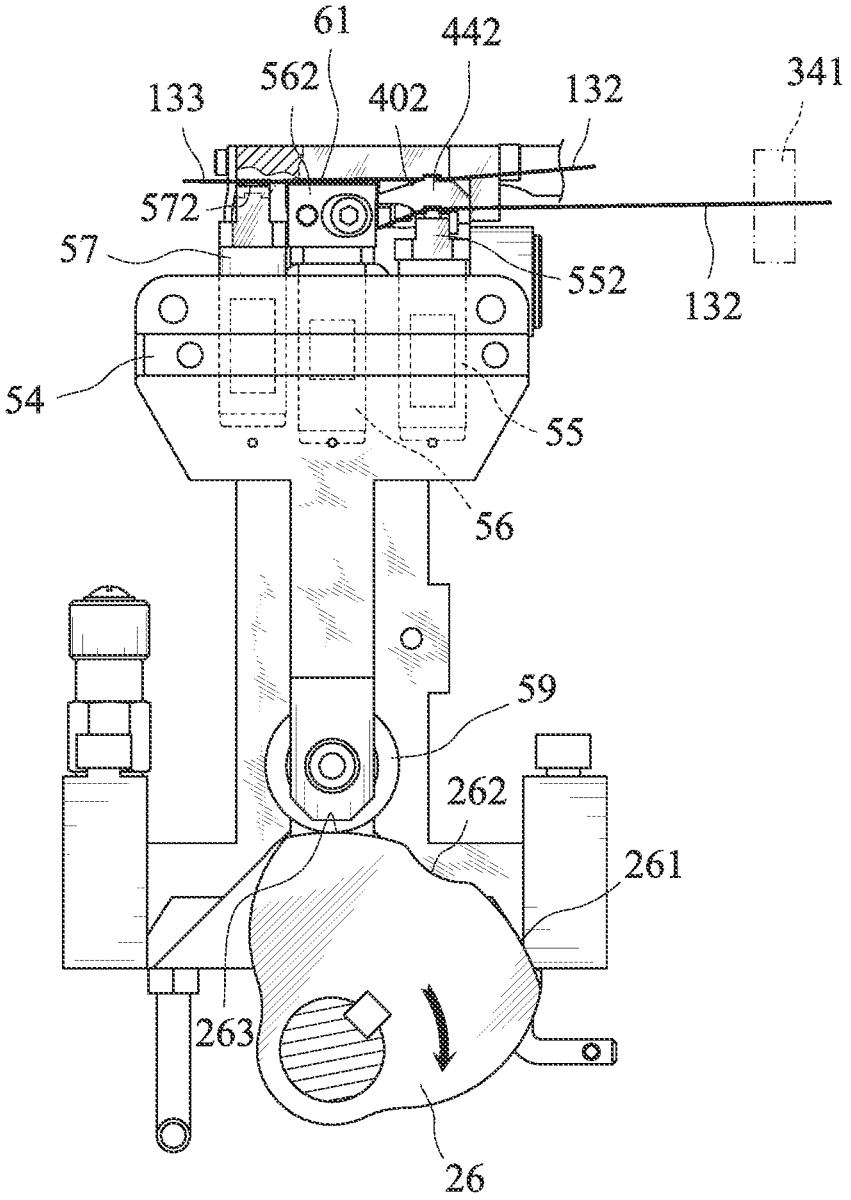
FIG. 22 is a schematic view which illustrates a stroke for the pressure lever holder pushed up by a rear convex portion of the third cam to allow the strap tail overlapping with the strap head to complete adhesion connection.
Figure 23:
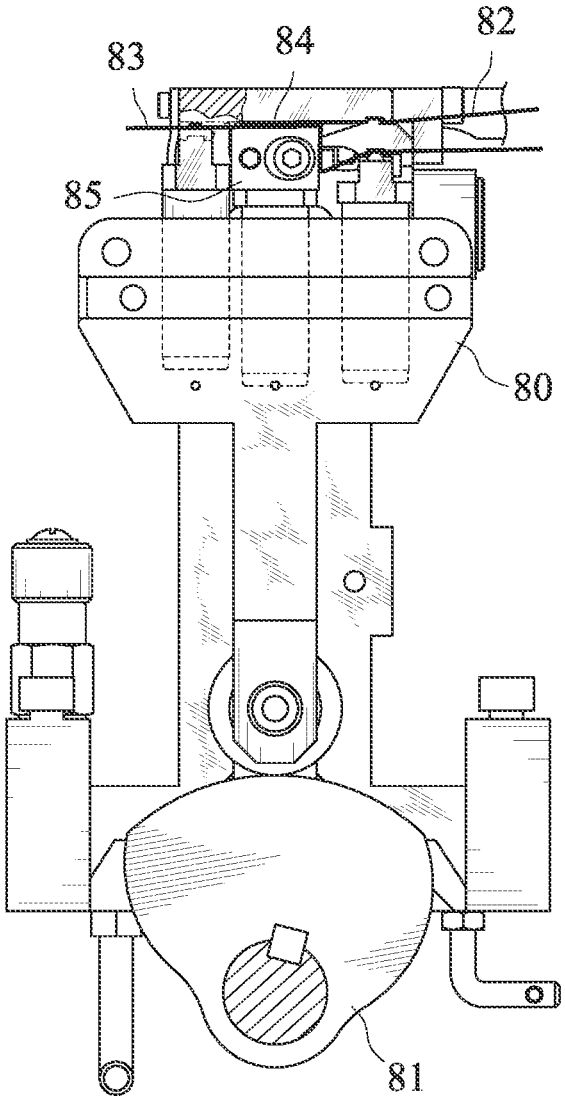
Fig. 23 Prior Art
FIG. 23 is a schematic view which illustrates a pressure lever holder in the prior art is pushed up.
Figure 24:
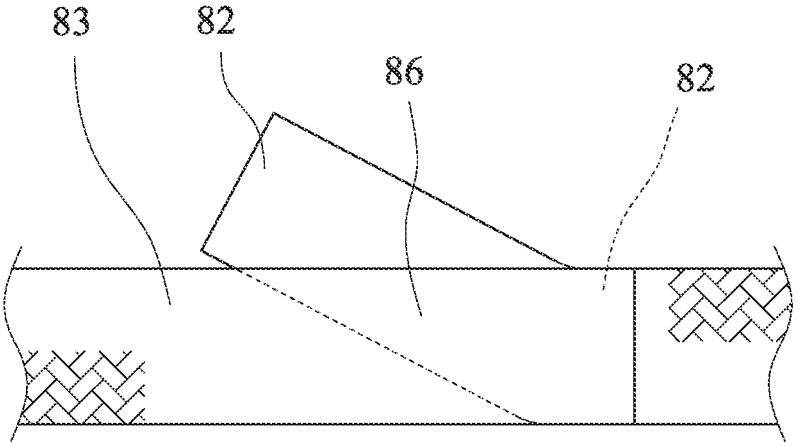
Fig. 24 Prior Art
FIG. 24 is a schematic view which illustrates a mismatch at a strap head and a strap tail of a strap, both of which overlap with each other, in the prior art.

Referring to FIG. 9 to FIG. 13 and FIG. 18 to FIG. 21, when object 70 is shifted from the conveyor area 11 to the strapping workbench 16 (FIGS. 11 and 12), the strap head 132 clamped by the gripper 341 is delivered to and pressed between the pressing portion 442 and the top portion 402, and the abutting roller 59 is driven by the rotating third cam 26 to make the pressure lever holder 50 at the lowest position (FIG. 19), where the stop lever 54 restricts the front pressure lever 55, the middle pressure lever 56 and the rear pressure lever 57 at the lowest position. Then, the spindle 22 rotates continuously. When the strap 131 led by the strap guiding arm 151 pass through the top portion 402 of the top holder 40 (FIG. 13), the abutting roller 59 pushed up by the front convex portion 261 drives the pressure lever holder 50 to move upward (FIG. 20), and the strap 131 is pulled by the strap guiding arm 151 to wrap under the top portion 402 and overlap with the strap head 132. At the same time, the connector 61 extends to the top portion 402. Since the lever tops 552, 572 are closer to the top portion 402 than the lever top 562, the strap 131 overlapped under the top portion 402 is first pressed by the first lever top 552 of the front pressure lever 55 against the lower end of the pressing portion 442, then pressed at the top portion 402 by the third lever top 572 of the rear pressure lever 57, and finally restricted under the connector 61 by the second lever top 562 of the middle pressure lever 56 sequentially (FIG. 20). Then, the strap 131 is cut by the middle pressure lever 56 and the front pressure lever 55. The portion of the strap 131 overlapped and close to the top portion 402 is the strap head 132, and the portion of the strap 131 overlapped and close to the middle pressure lever 56 is the strap tail 133. The cut strap 131 is clamped by the gripper 341 at the same time, and the portion of the strap 131 between the front pressure lever 55 and the gripper 341 is developed to be a new strap head 132. At this moment, the connector 61 is ready for the connection preparation of the strap head 132 and the strap tail 133. The so-called connection preparation includes applying welding, bonding and/or thermal fusion. The connector 61 may be, for example, a welding head, an ultrasonic welding head or a heating plate. The spindle 22 rotates continuously. After the connection preparation is made for a period of time (that is, the stroke of the front convex portion 261 of the third cam 26 is completed), the abutting wheel 59 will fall into the recess 262 (FIG. 21), and the middle pressure lever 56 descends due to the second concave portion 561 driven by the stop lever 54, so that the strap tail 133 overlapping with the strap head 132 is loosened. When the pressure lever holder 50 is pushed up by the front convex portion 261, a vertical distance (D) between the bottom of the stop lever 54 and the bottom of each of the concave portions 551, 571 is greater than a vertical distance between the front convex portion 261 and the recess 262 (that is, a radial concave depth of the recess 262 relative to the front convex portion 261). Accordingly, when the middle pressure lever 56 descends, the strap 131 overlapped under the top portion 402 is still pressed by the front pressure lever 55 and the rear pressure lever 57. At this moment, the connector 61 retracts from the top portion 402 such that the overlapping strap head 132 and the strap tail 133 will not be pulled by the retracted connector 61 to cause misalignment. Then, the spindle 22 still rotates continuously, and the abutting roller 59 is pushed up by the rear convex portion 263 (FIG so that the strap head 132 and the strap tail 133, both of which have completed the connection preparation, is pressed by the second lever top 562 of the middle pressure lever 56 and complete adhesive connection. Then, the pressure lever holder 50 descends and both the object 70 and the top portion 402 of the top holder 40 are bundled by the strap 131 which is completely adhered. Finally, both the top holder 40 and the pressure lever holder 50 tilt (FIG. 9), so that the strap 131 under the top portion 402 of the top holder 40 is detached from the top holder 40 and bundles the object 70 completely.

Figure 11:
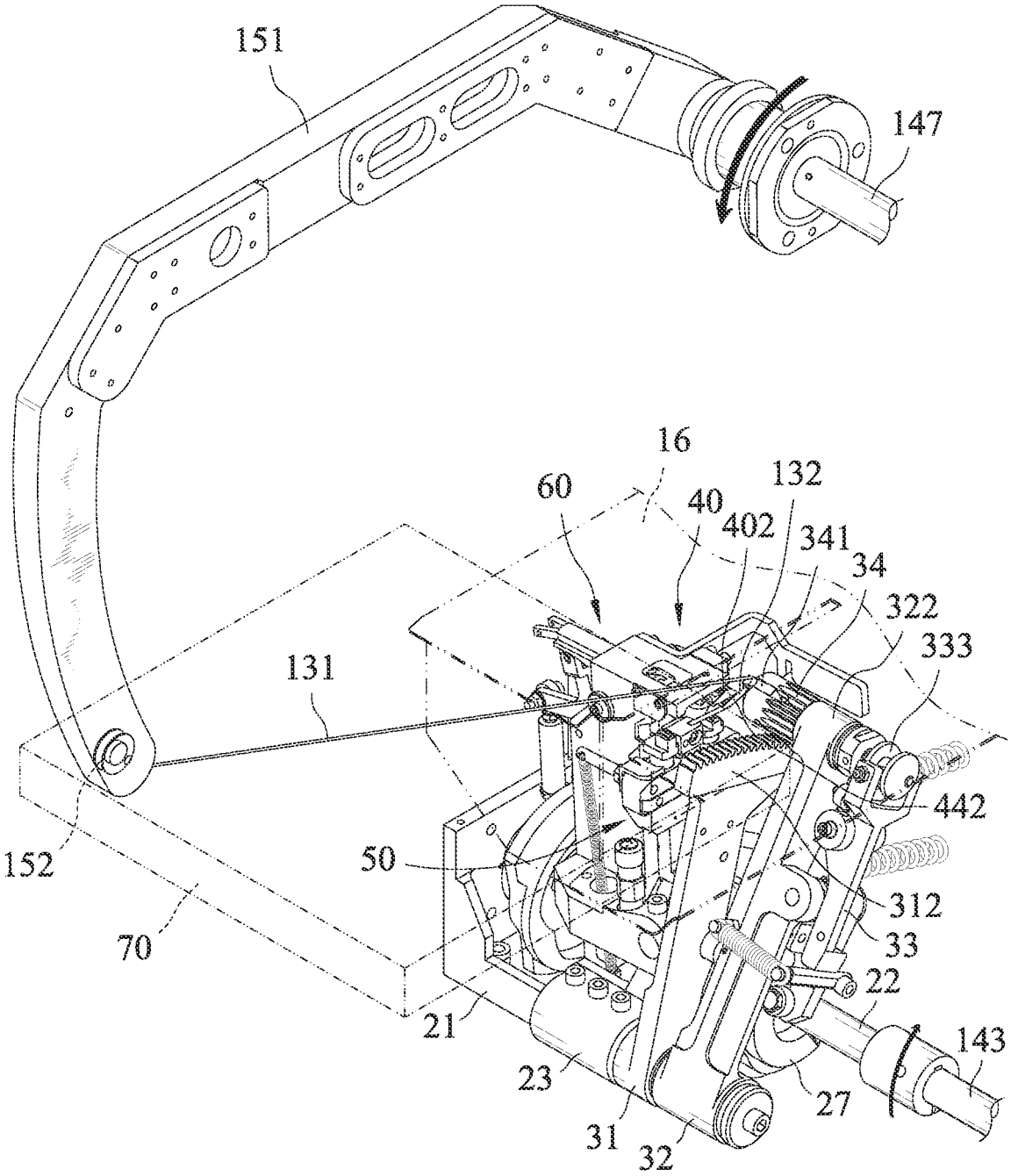
FIG. 11 is a schematic view which illustrates an object is ready to be bundled.
Figure 12:
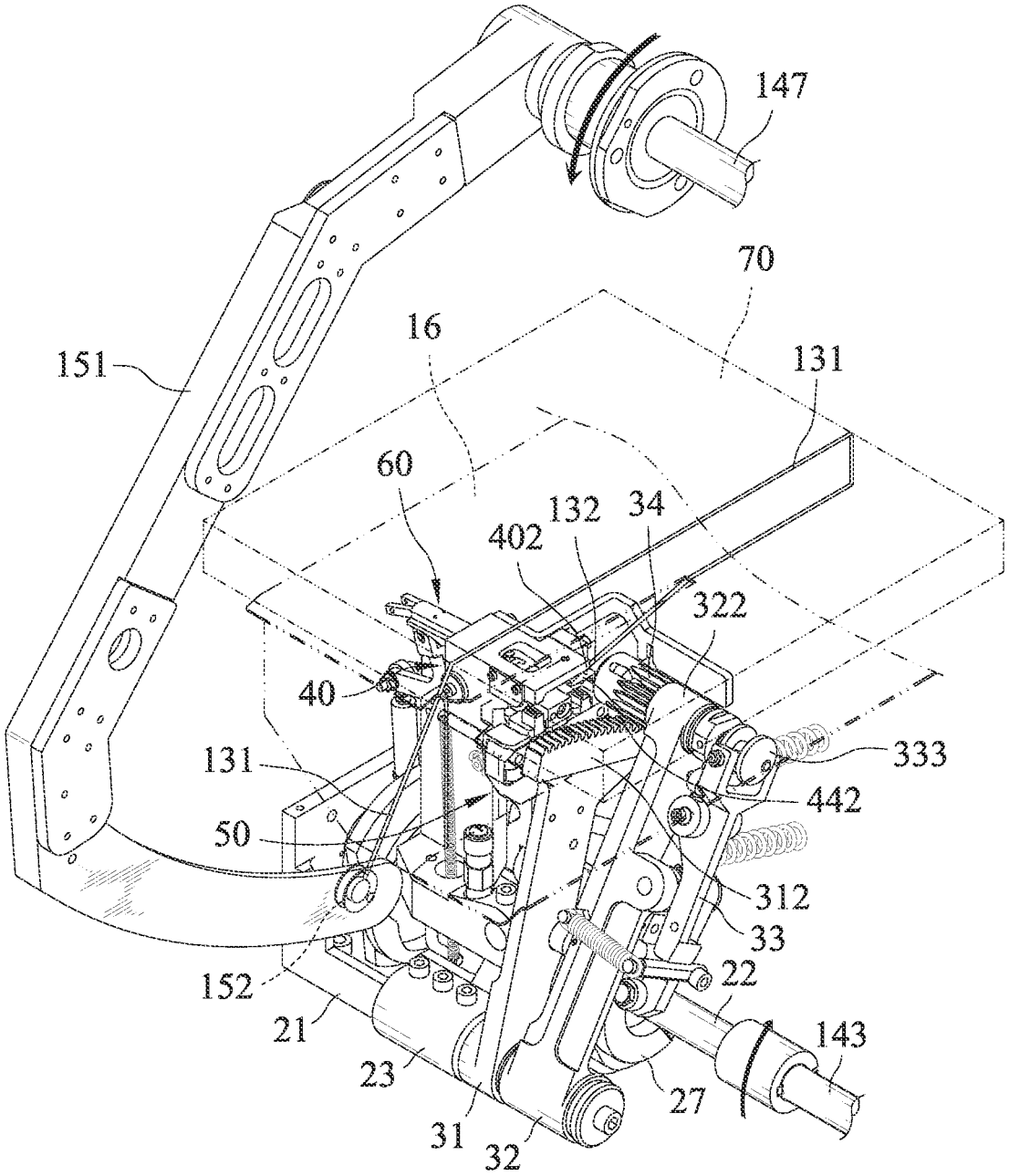
FIG. 12 is a schematic view which illustrates the object in FIG. 11 is being bundled by a length of the strap.
Figure 13:
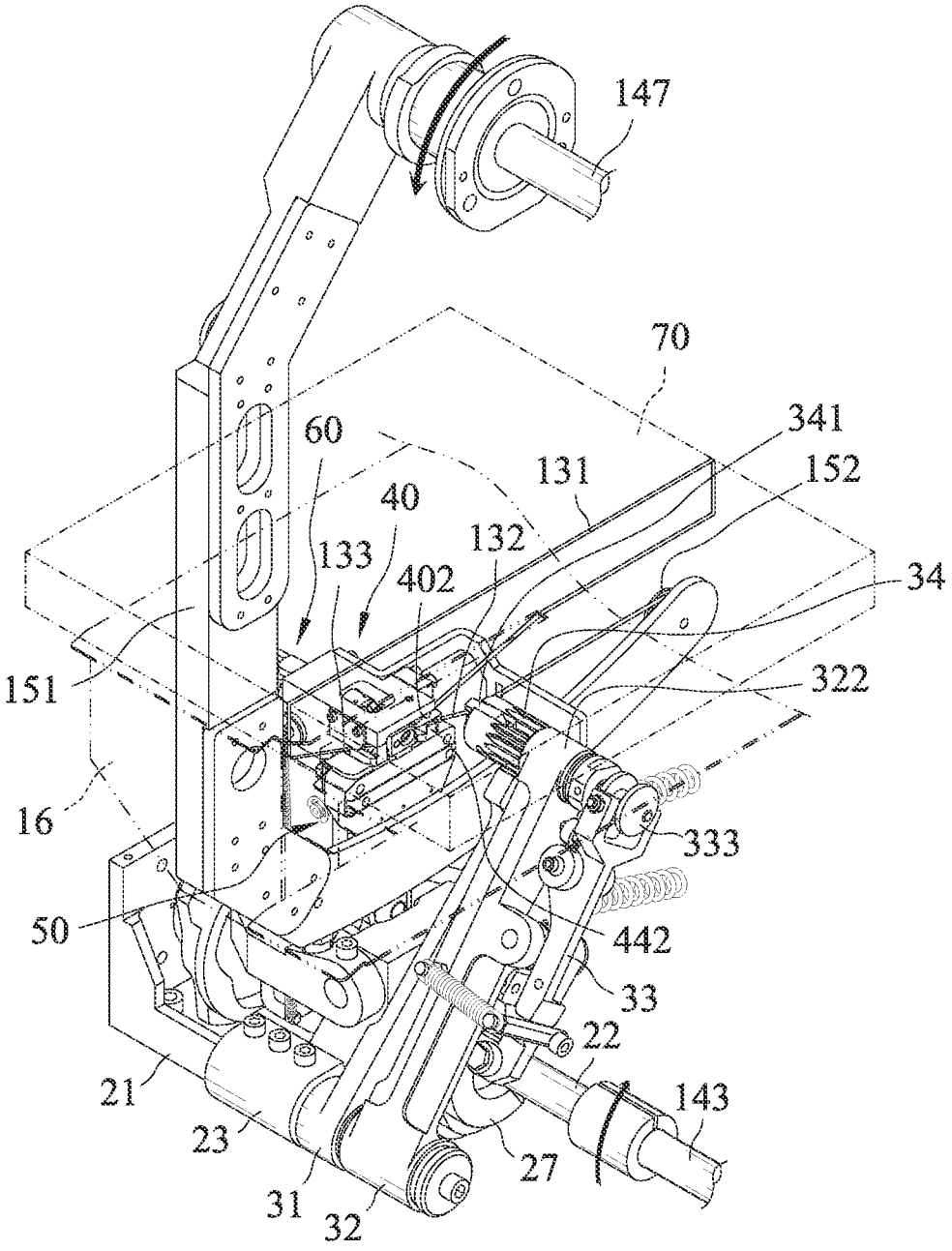
FIG. 13 is a schematic view which illustrates the object in FIG. 12 has been bundled.
Figure 14:
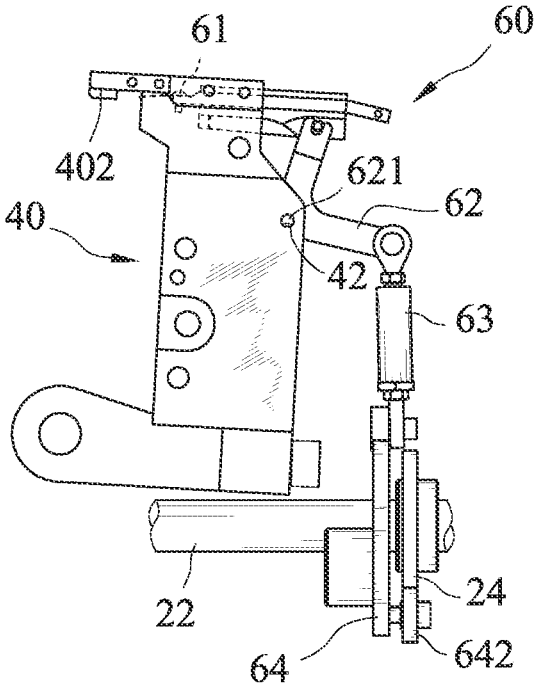
FIG. 14 is a schematic view which illustrates a connection device retracts in the top holder.
Figure 15:
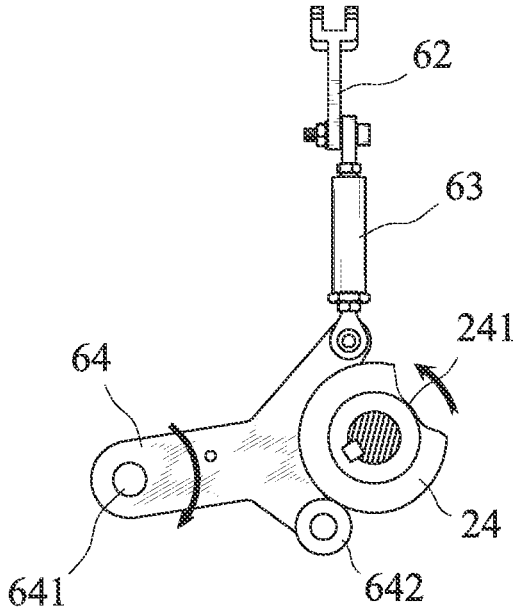
FIG. 15 is an end view corresponding to FIG. 14 and also is a schematic view of the operation of a shift fork and a first cam when the connection device is retracted.
Figure 16:
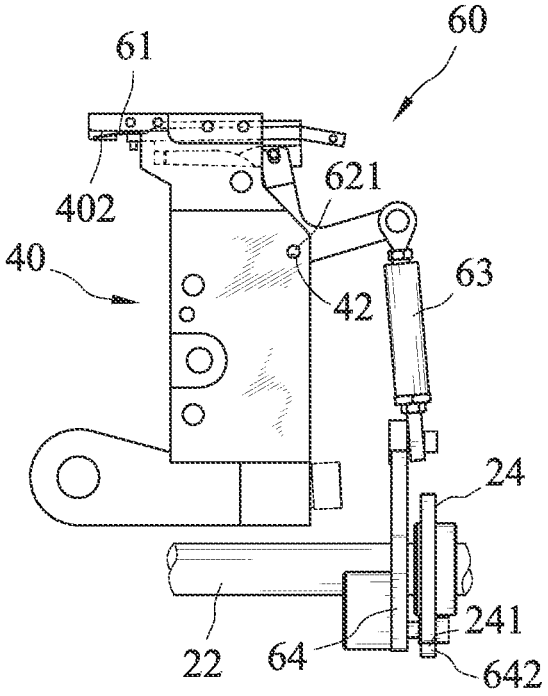
FIG. 16 is a schematic view which illustrates the connection device extends in the top holder.
Figure 17:
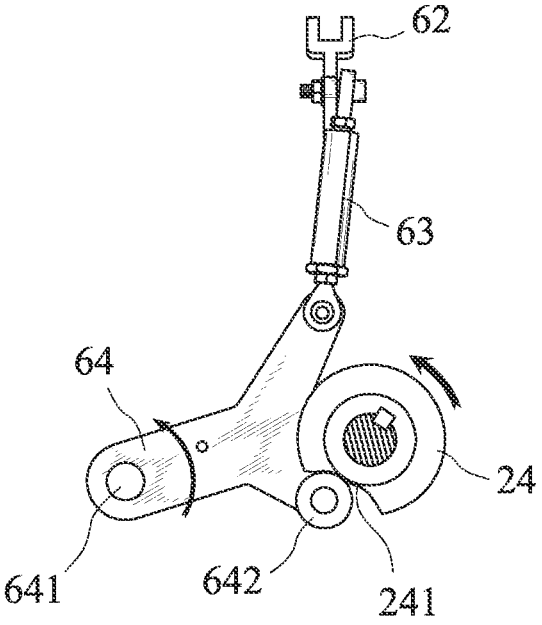
FIG. 17 is an end view corresponding to FIG. 16 and also is a schematic view of the operation of the shift fork and the first cam when the connection device extends.

With the new strap head 132 clamped by the gripper 341, the holding rod 32 following the strap guiding arm 151 swings back and is kept at a position for the first stage (FIG. 11). At the same time, the new strap head 132 rotates with the toothed holding roller 34. The swing back of the holding rod 32 is such that when the new strap head 132 is again transferred between the pressing portion 442 and the top portion 402, the new strap head 132 strides over the middle pressure lever 56 for the next cycle of the strap 131 bundling an object 70.

When the abutting roller 59 is pushed up by the front convex portion 261, the lowest portion of the stop lever 54 is located at or adjacent to the lowest portion of the second concave portion 561 (FIG. 20), and the vertical distance (D) between the bottom of the stop lever 54 and the bottom of each of the concave portions 551, 571 is greater than the radial concave depth of the recess 262 relative to the front convex portion 261.

The strokes of the front convex portion 261, the recess 262 and the rear convex portion 263 of the third cam 26 with respect to the strap 131 can be described as follows. The front convex portion 261 is a stroke for pressing, cutting and connecting preparation, the recess 262 is a stroke for relaxation and completion of connection preparation, and the rear convex portion 263 is a connection adhesion stroke.

The scope of the invention is to be indicated by the appended claims, rather than by the foregoing description, and all changes which come within the meaning and range of equivalency of the claims are intended to be embraced therein.

The invention claimed is:

1. A relaxation device of a cardboard strapping machine, comprising:

a base provided with a conveyor area and a strapping area on which a strapping workbench and a strap guiding arm are installed, with a strapping device provided under the strapping workbench and including a bottom seat, with a supporting holder, a shift fork holder and a spindle provided on the bottom seat, wherein the spindle is equipped with a first cam, a second cam and a third cam, with the first cam having a recessed portion therein, wherein the third cam is provided with a front convex portion and a rear convex portion;

a top holder pivotally mounted to the supporting holder of the bottom seat and having a top portion and a connective channel extending through an upper end of the top holder and to the top portion, wherein the top holder can be driven by the second cam;

a pressure lever holder installed in the top holder and movable inside the top holder up and down, with the pressure lever holder provided with three pressure lever holes, an abutting roller and a groove, with the three pressure lever holes respectively accommodating a front pressure lever, a middle pressure lever and a rear pressure lever, wherein the front pressure lever, the middle pressure lever and the rear pressure lever are respectively provided with a first concave portion and a first lever top, a second concave portion and a second lever top, and a third concave portion and a third lever top, with a spring received in each of the three pressure rod hole, wherein the groove accommodates a stop lever which is received in the first, second and third concave portions so that the front pressure lever, the middle pressure lever and the rear pressure lever ascend or descend synchronously with the stop lever following the pressure lever holder to ascend or descend; and a connection device including a connector and a shift fork, with the connector being movably inserted into the top holder, with the shift fork pivotally mounted to the shift fork holder through a shift fork shaft and provided with a fork wheel at an end thereof, wherein the fork wheel abuts against the first cam so that the connector can be extended into or retracted from the top holder during rotation of the first cam, with the abutting roller abutting against the third cam, wherein a length of strap is pulled into the strapping device by the strap guiding arm, overlapped under the top portion, and pressed by the front pressure lever, the middle pressure lever and the rear pressure lever;

characterized in that the third cam is further provided with a recess, wherein when the abutting wheel is in the recess of the third cam, the fork wheel just moves away from the recessed portion of the first cam, the strap overlapped under the top portion is still pressed by the front pressure lever and the rear pressure lever, but the middle pressure lever descends to loosen the overlapping straps at the middle pressure lever, so that when the connector retreats from the connective channel, the strap is not pulled by the retracted connector to cause misalignment.

2. The relaxation device as claimed in claim 1, wherein when the abutting roller is pushed up by the front convex portion of the third cam, a vertical distance between a bottom of the stop lever and a bottom of each of the first and third concave portions is greater than a radial concave depth of the recess relative to the front convex portion of the third cam.

3. The relaxation device as claimed in claim 2, wherein the recess is provided between the front convex portion and the rear convex portion of the third cam, wherein when the abutting roller arrives at the rear convex portion, the strap overlapped is pressed by the middle pressure lever.

4. The relaxation device as claimed in claim 1, wherein the connector is a welding head, an ultrasonic welding head or a heating plate.

5. The relaxation device as claimed in claim 2, wherein the connector is a welding head, an ultrasonic welding head or a heating plate.

6. The relaxation device as claimed in claim 3, wherein the connector is a welding head, an ultrasonic welding head or a heating plate.

* * * * *